US005988179A

United States Patent [19]

Jenkins et al.

[11] Patent Number: 5,988,179

[45] Date of Patent: Nov. 23, 1999

[54] METHOD AND MACHINE FOR CREATING NAIL ART ON PERSON'S DIGIT

[75] Inventors: Nevin C. Jenkins, Homosassa; Rande W. Newberry, Palm Harbor, both of Fla.

[73] Assignee: Fashion Nails, Inc., Homosassa, Fla.

[21] Appl. No.: 09/056,635

[22] Filed: Apr. 8, 1998

[51] Int. Cl.[6] ..... A45D 29/00

[52] U.S. Cl. ..... 132/200; 132/73

[58] Field of Search ..... 132/73, 285, 200; 101/33, 163, 166, 193, 41

[56] References Cited

U.S. PATENT DOCUMENTS

| | | | |
|---|---|---|---|
| Re. 14,619 | 3/1919 | Moeller . | |
| 310,784 | 1/1885 | Bollinger . | |
| 1,594,431 | 8/1926 | Thomson . | |
| 1,728,512 | 9/1929 | Sharp . | |
| 2,031,225 | 2/1936 | O'Donnell . | |
| 2,180,519 | 11/1939 | Hamilton et al. . | |
| 2,220,758 | 11/1940 | Florio . | |
| 2,245,929 | 6/1941 | Mangold . | |
| 2,246,729 | 6/1941 | Gutberlet . | |
| 2,262,977 | 11/1941 | Vasil . | |
| 2,287,062 | 6/1942 | Powers et al. . | |
| 2,296,795 | 9/1942 | Landsman . | |
| 2,454,004 | 11/1948 | Pettyjohn . | |
| 2,485,384 | 10/1949 | Klein . | |
| 2,519,335 | 8/1950 | Ballou et al. . | |
| 2,524,322 | 10/1950 | Lipnicki et al. | 132/285 |
| 2,580,893 | 1/1952 | Dee . | |
| 2,701,520 | 2/1955 | Rider | 101/163 |
| 2,735,435 | 2/1956 | Feinstein . | |
| 2,799,282 | 7/1957 | Slack . | |
| 2,842,046 | 7/1958 | Murray . | |
| 3,070,906 | 1/1963 | Tinsley . | |
| 3,094,920 | 6/1963 | Priesmeyer . | |
| 3,164,259 | 1/1965 | De'Caccia . | |
| 3,461,885 | 8/1969 | Coveney . | |
| 3,480,020 | 11/1969 | Ernest . | |
| 3,515,154 | 6/1970 | Morgese . | |
| 3,598,685 | 8/1971 | Lee et al. | 132/73 |
| 3,898,357 | 8/1975 | Miller et al. . | |
| 3,916,784 | 11/1975 | Dubuit . | |
| 4,019,436 | 4/1977 | Handweiler et al. . | |
| 4,060,031 | 11/1977 | Philipp . | |
| 4,314,504 | 2/1982 | Combeau . | |
| 4,508,032 | 4/1985 | Philipp . | |
| 4,738,199 | 4/1988 | Chen . | |
| 4,803,922 | 2/1989 | Dennesen | 101/41 |
| 4,915,239 | 4/1990 | Persch . | |
| 4,968,253 | 11/1990 | Thomas . | |
| 5,090,320 | 2/1992 | Nave | 101/41 |
| 5,133,369 | 7/1992 | Billings | 132/73 |
| 5,151,386 | 9/1992 | Bottari et al. . | |
| 5,269,330 | 12/1993 | Hayes | 132/73 |
| 5,277,205 | 1/1994 | Jenkins . | |
| 5,302,224 | 4/1994 | Jenkins et al. | 101/163 |
| 5,316,026 | 5/1994 | Jenkins | 132/285 |
| 5,743,180 | 4/1998 | Arnke . | |

*Primary Examiner*—Todd E. Manahan
*Attorney, Agent, or Firm*—Evenson, McKeown, Edwards & Lenahan, PLLC

[57] ABSTRACT

A hand operated self-contained machine made out of molded plastic for applying an image on a nail of a person's digit or a golf ball, consisting of a base frame including side rails. An element is provided to establish a reference point. An image creating holder is integrally molded to the side rails. A wheel having projections holding a plate containing a plurality of images is supported on the holder and can be indexed to any one of a plurality of positions by the interaction of the projections and the holder. An image composed of an image defining coating material is created at one image position on the plate. A positioning member receives and adjustably positions a person's digit or object in an appropriate orientation relative to the reference point. A transfer member is mounted on the side rails and a manually operable drive member drives the transfer member in a continuous smooth movement, and a method wherein the support of the image plate is indexed to present a new image.

20 Claims, 12 Drawing Sheets

METHOD AND MACHINE FOR CREATING NAIL ART ON PERSON'S DIGIT

FIELD OF INVENTION

The present invention relates to a method and machine for creating nail art on a person's digit, and more particularly, relates to a method and hand operated machine for creating an art image on a fingernail or toenail of a person's digit.

BACKGROUND AND SUMMARY OF THE INVENTION (a) Prior Art

The desirability of creating art images on a person's fingernails and toenails is widely recognized and practiced. Known techniques include transfer, decals, appliques and handpainting. Recently, U.S. Pat. Nos. 5,277,205; 5,302,224; and 5,316,026 have been granted regarding novel techniques for creating images on nails. Although the new technology works well in principle, there remains a need to further develop the technology in order to advance it to the point where complex multicolor images can created especially by professional nail technicians, consistently and repeatably with excellent registration and detail. Also, there remains a need to improve and engineer the known apparatus to enable manufacture both efficiently and economically.

(b) Summary of Invention

Therefore, the principal object of the present invention is to provide a method and machine or apparatus for effectively creating nail art on the nail of a person's digit, and to do so to accomplish the noted purposes. To this end, the invention provides hand-operated apparatus that can be manufactured efficiently and readily, and that will be of rugged construction and will function effectively, smoothly and repeatably, especially when being worked by a professional nail technician.

Accordingly, the present invention achieves the principal object of the invention by a method for applying an art image on a person's nail that comprises the steps of establishing a reference point, positioning a person's digit relative to the reference point on an adjustable supporting base at a first preselected location, creating an image composed of an image defining coating material at a location remote from the first preselected location, picking up the created image from said remote location by a transfer element movably mounted, transferring the picked up image to the person's nail at said first preselected location in one smooth continuous motion that results in the picked up image being deposited onto the person's nail at a position on the nail correlated with the reference point.

In the method, the pick up and transfer of the image is by a smooth continuous motion that results in the depositing of the picked up image. Further, the transfer of the picked up image is effected with guiding. The step of creating the image may include the steps of depositing coating material onto an image plate and doctoring excess coating material in the creation of the image. The method steps can be repeated a multiple of times with easy repositioning of the plate between successive times. The method can further include a step of positively stopping the picked up created image in proper orientation to the person's nail during transfer, and the ready adjustment of the person's nail. The method can be carried out to create a multi-color image.

The present invention additionally contemplates a hand operated self-contained machine for applying an image on a person's nail comprising a base frame, side rails attached to the base frame, an element for establishing a reference point, and image creating plate attached to the side rails for creating thereon an image composed of an image defining coating material, a digit positioning member for adjustable receiving and positioning a person's digit relative to the location of the created image to achieve the appropriate orientation relative to the reference point, a transfer member mounted on the side rails movable for transferring the created image from the image creating plate to the person's nail, and a manually operable drive member to drive the transfer member.

The machine may further be characterized in that the transfer member includes a squeegee for removing excess coating material from an image and a pick up pad for picking up a created image. The machine or apparatus can further include guide elements to guide the transfer member during movement. In the machine the squeegee and the pick up pad may be mounted in common, with the pad mounted also for vertical movement. The machine may further comprise an adjustable digit positioning member for adjusting with respect to the reference point, for indexing the pick up pad relative to the person's nail. Also, the machine may have the digit positioning member contained in a holder and spring biased upwardly.

Other objects and advantages of the present invention will become readily apparent from the following.

DESCRIPTION OF PREFERRED EMBODIMENTS

Figure 17:
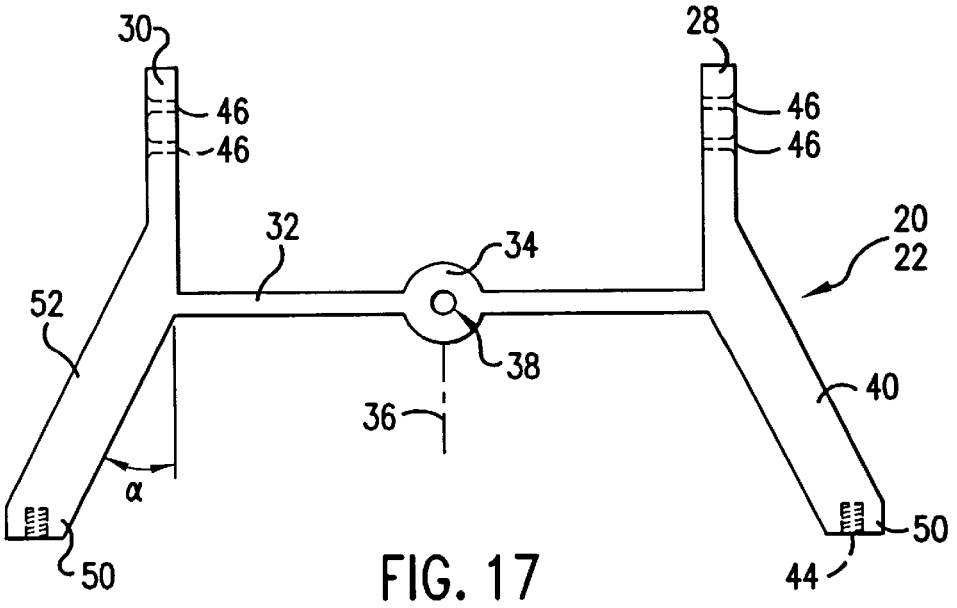
FIG. 17 is a front elevation of the base legs.
Figure 18:
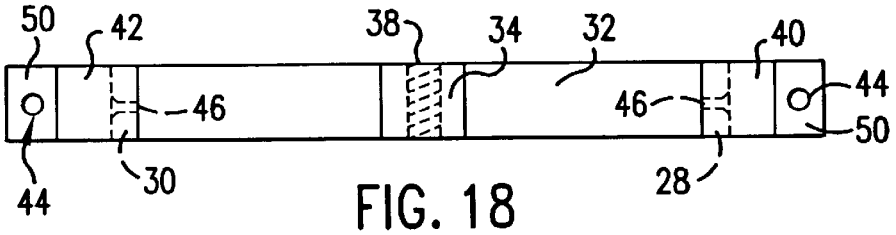
FIG. 18 is a bottom plan of the base legs.

Referring now to the drawings, the machine and method of the present invention will now be described in detail. Referring initially to FIGS. 1–4, the machine is comprised of a forward leg structure 20 and rear leg structure 22 which together with two side rails 24 and 26 constitute the machine frame. Components are made of metal, such as, aluminum, except as stated. The leg structures 20 and 22 are shown in detail in FIGS. 17 an 18 and each consists of a pair of upper leg parts 28 and 30 that extend vertically. A cross bar 32 extends horizontally and integrally interconnects upper leg parts 28 and 30. A hub 34 is integrally formed at the center line 36 and through hole 38 is defined by hub 34 extending horizontally and normal to vertical centerline. Lower leg parts 40 and 42 are thickened and displayed at an angle $\alpha$ (from about 10° to about 30°, preferably about 15°) lower surfaces 50 of parts 40 and 42. Threaded bolt holes 44 are formed in the suction pads 45 are bolted to leg parts 40, 42 via holes 44. Pairs of clearance bolt holes 46 are formed in the upper leg part 28 and 30 so that the side rails 24 and 26 can be bolted by bolts 48 to the upper leg parts 28 and 30.

The side rails 24 and 26, as noted, are fastened to the leg structures 20, 22 by bolts 48. Each side rail 24, 26 defines a longitudinally, horizontally extending slot 60, of uniform width, which terminates fore and aft with short vertically extending slots 62, 64 respectively, of the same uniform width. Slots 62 and 64 at their bottom ends are arcuate with a radius equal to one-half of the slot width. A lever 68 consisting of a pair of arms 70 and 72 interconnected by a cylindrical handle 74 via bolts 82 at their upper ends 76 also, are pivotally coupled at their lower ends 78 to the side rails 24, 26 by any suitable means, e.g. shoulder bolts 80 which permit pivoting. Preferably, handle 74 is arranged, e.g. by shoulder bolts, to be rotatable for ease of manipulation. A second reinforcement cylinder 84 is bolted by bolts 86 to the arms 70, 72 vertically below cylinder 74. Each arm 70, 72 defines a longitudinally extending slot 88 at a location that intercept slot 60, including segments 62, 64 for the full range of movement of the lever 68.

The side rails 24 and 26 define in their inside surfaces, a first pair of longitudinally, horizontally extending guide slots 90, that extend the entire length of the side rails 24, 26, and intercept the arcuate bottoms of the slots 62, 64. Adjacent the bottom edges of the side rails 24, 26, starting from their front edges, a pair of slots 92 are defined in the inside surfaces of the side rails 24, 26. This pair of slots 92 extends longitudinally and horizontally for about one-third the length of the side rails.

Figure 1:
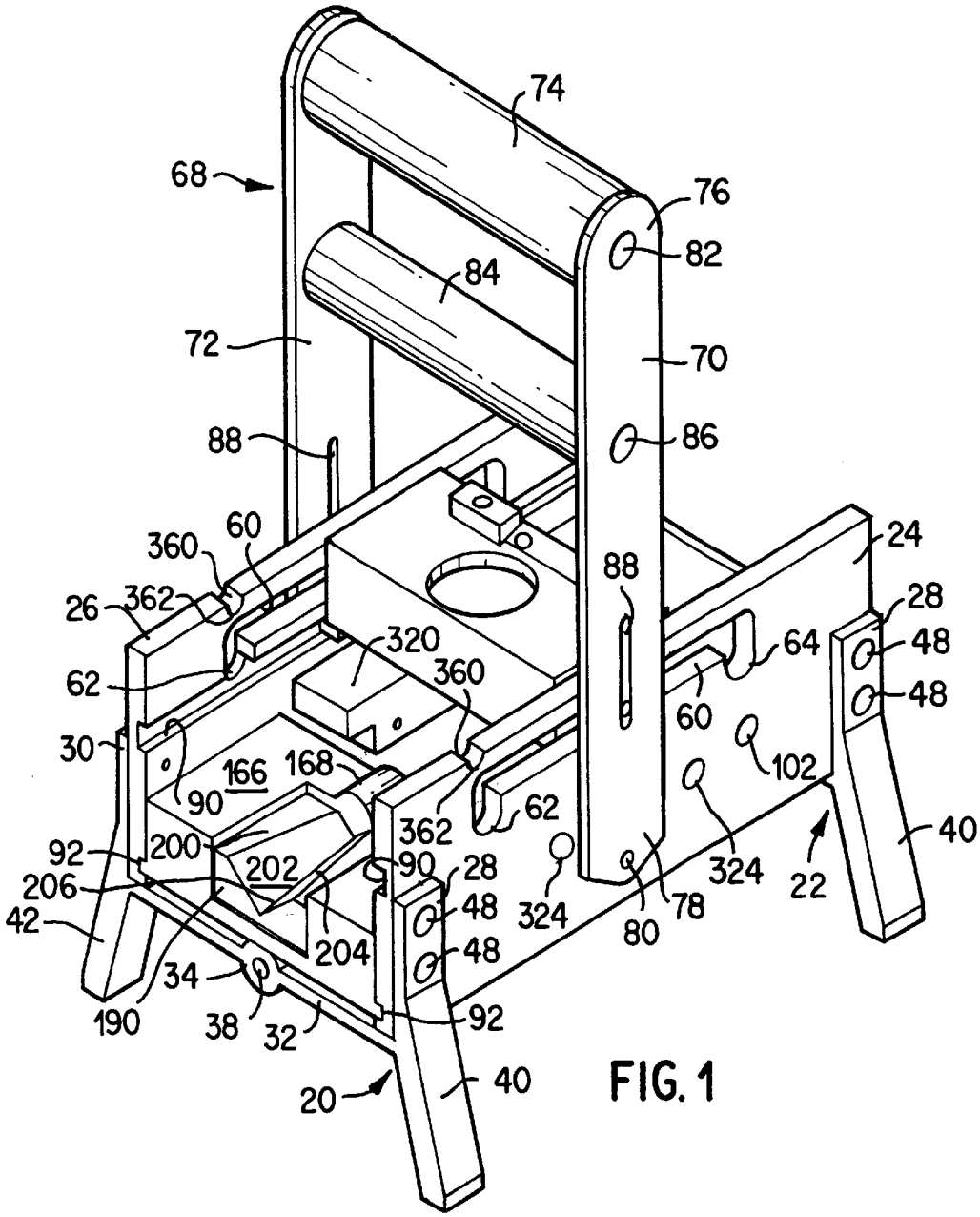
FIG. 1 is a perspective view showing the novel machine or apparatus in the middle position, with the suction pads and plate holder sub-assembly removed.
Figure 2:
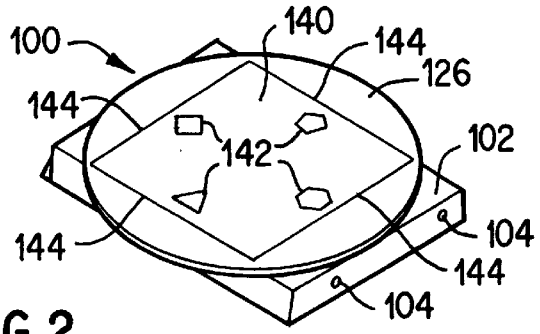
FIG. 2 is a perspective view of the plate holder, turntable sub-assembly.
Figure 3:
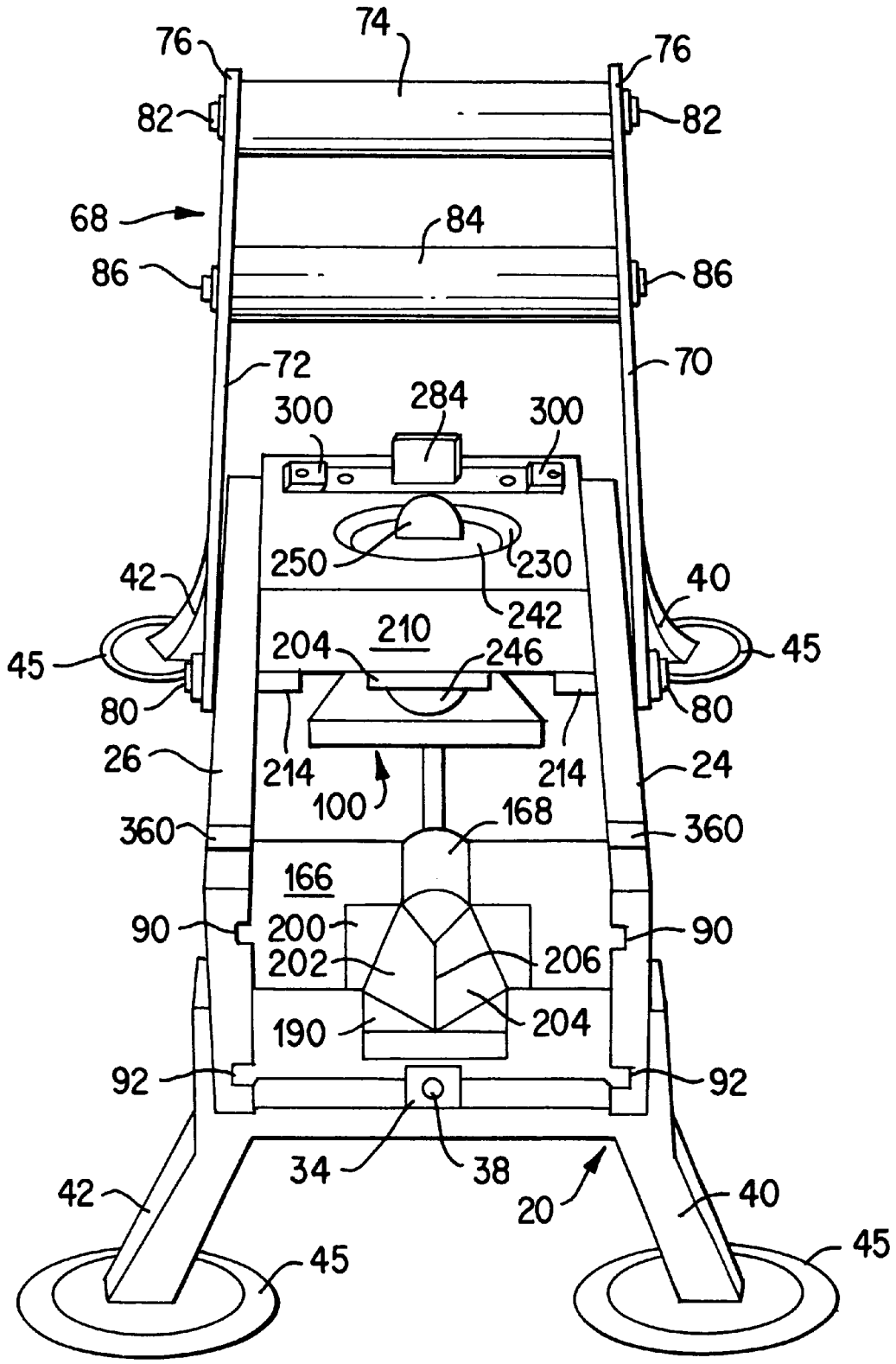
FIG. 3 is a perspective view from the front of the major parts of the novel machine.
Figure 4:
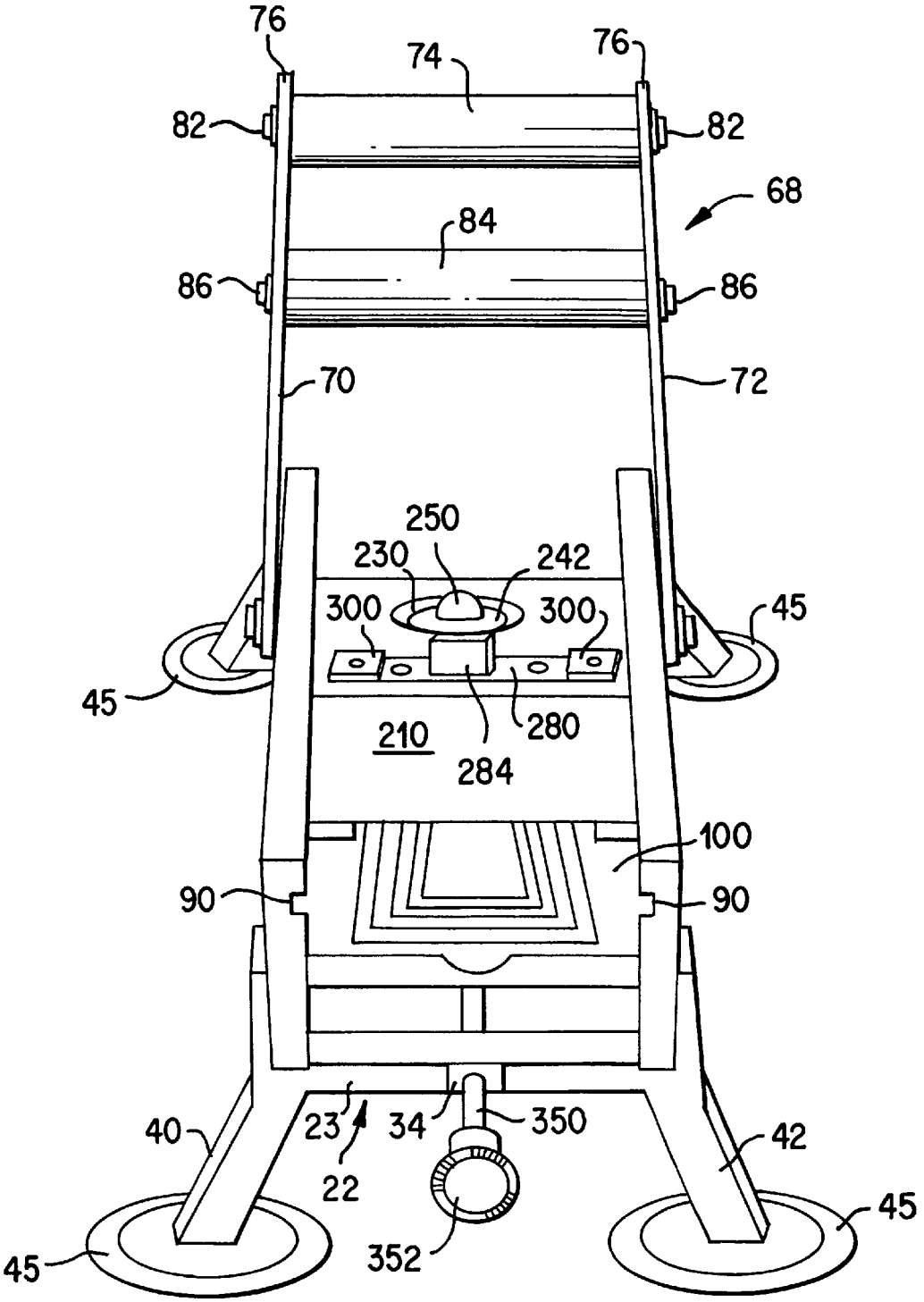
FIG. 4 is a perspective view from the rear of the major parts of the novel machine.

A plate holder, turntable assembly 100 shown in FIG. 2 and in detail in FIGS. 5–8 is fixed in position between the side rails 24, 26 by any suitable means, e.g. by longitudinally spaced bolts 102, one of which is shown in FIG. 1 for side rail 24. The other bolt is hidden under upper leg part 28. The assembly 100 is fixed above the bottom edges of the side rails by ⅓ to ½ their height. The assembly 100 consists of a base plate 102 defining pairs of threaded bolt holes 104 along each plate side 112 for receiving bolts 102 and effecting attachment to side rails 24, 26. Plate 102 also defines in its upper surfaces 110 a circular recess 108, and a threaded hole 114 extending from the rear edge 106 of plate 102. A detent, not shown, in the form of a threaded shank housing a spring loaded projecting ball detent, is threadedly received in hole 114 with the detent projecting slightly into the recess 108.

Figure 5:
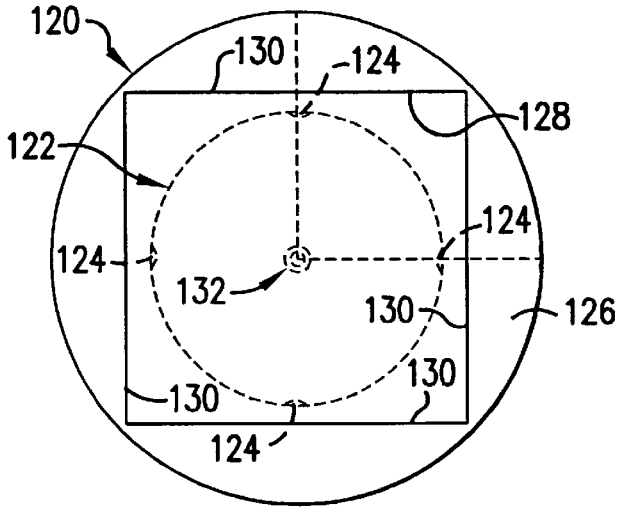
FIG. 5 is a top plan view of the plate holder turntable.
Figure 6:
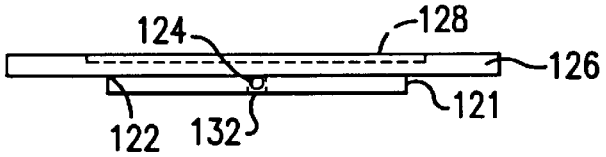
FIG. 6 is a side elevation of the plate holder turntable.
Figure 7:
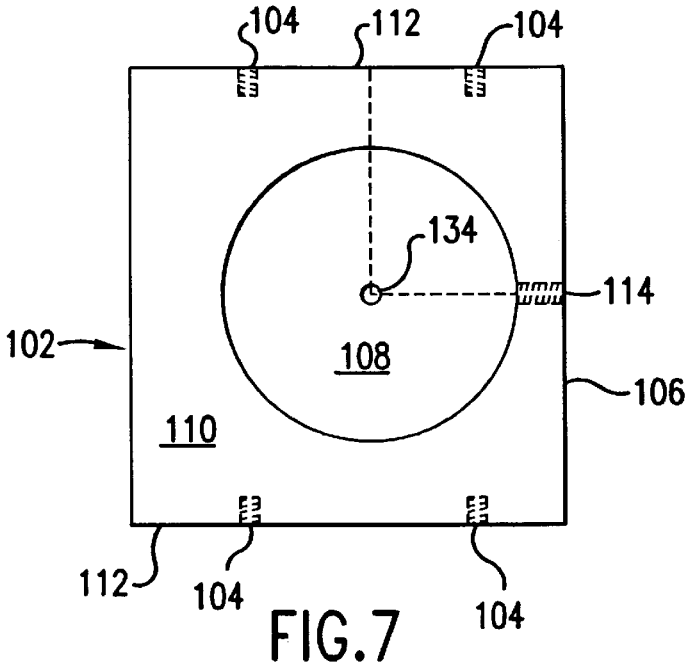
FIG. 7 is a top plan view of the turntable base.
Figure 8:
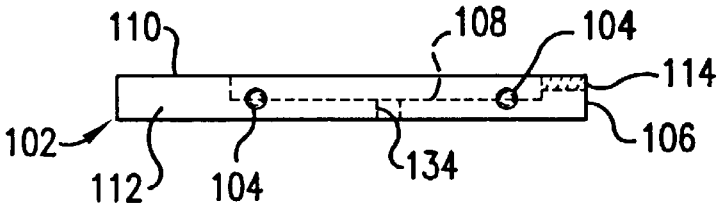
FIG. 8 is a side elevation of the turntable base.

Assembly 100 further consists of a turntable 120, illustrated in FIGS. 5 and 6 which further consists of a lower circular table 122 having a diameter watching that of recess 108. At 90° intervals, the rim 121 of table 122 is interrupted by recesses 124 for cooperation with the ball detent. Fixed to the upper surface of table 122 is a wheel 126 of greater diameter. A square recess 128 is defined in the upper surface of which 126 with an orientation such that each recess 124 is exactly aigned with the midpoint of each side 130 of square recess 128. A central axial threaded bolt hole 132 extends through table 122 and into wheel 126. Base 102 defines a central axial hole 134 through which a shoulder bolt, not shown, passes for threaded connection with hole 132. In this manner the assembly 100 is mounted between the side rails 24 and 26 and the turntable assembly (table 122 and wheel 126 are rotatably received in circular recess 108 of table base 102). As shown in FIG. 2 an engraved metal plate 140 is received in the square recess 128. Plate 140 contains four engravings 142 indexed with respect to the midpoint of each side 144 of plate 140, which in turn, is coincident with the midpoint of each side 130 of recess 128.

A nail block holder and nail block are shown in FIGS. 15, 16 and 33 and FIGS. 9–11, respectively. Nail block holder 150 is mounted for sliding movement between side rails 24, 26. More particularly, holder 150 is generally of rectangular block shape defining cutouts and projections. Along the lower part of each side 152 of holder 150 and for its length, a rail 154 projects that is dimensioned to be received in and slide relative to guide slots 92. Holder 150 defines a rectangular cutout 156 on its front side 158 with four through holes 160 extending from the bottom 162 of holder 150 to the floor 164 of cutout 156. On the top face 166 of holder 150 is a hemi-cylindrical projection 168 extending from the top black edge 170 to the top rear edge 172 of the cut-out 156. On the bottom surface 162, a projection 174 extends from the bottom back edge 176 a short distance toward the front along the plane including the front-to-back centerline 178. An axial threaded bore 180 penetrates the projection 174.

Figure 9:
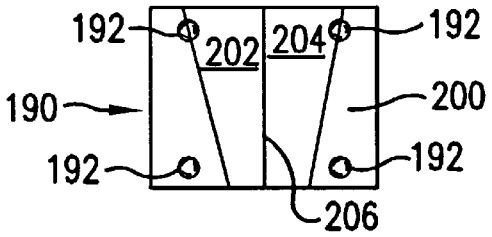
FIG. 9 is a top plan view of the nail block.
Figure 10:
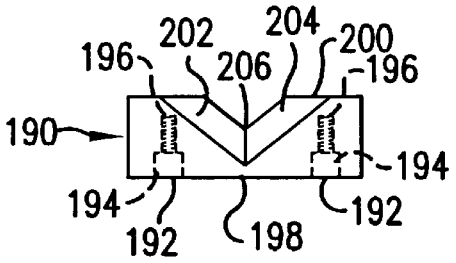
FIG. 10 is an end elevation of the nail block.
Figure 11:
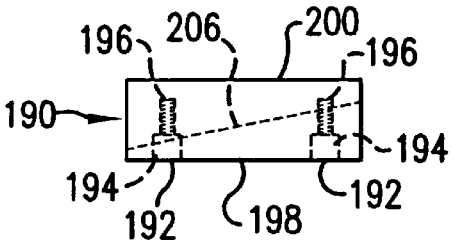
FIG. 11 is a side elevation of the nail block.

Received in the cutout 156 is a nail block 190 shown in FIGS. 9–11. Block 190 is a parallel piped defining four bores 192 extending vertically from its bottom surface 198. Each bore 192 is located in proximity with a corner of block 190. Each bore 192 has an enlarged entry portion 194 with a deeper threaded portion 196. The upper surface 200 of block 190 is cutout to define inclined surfaces 202 and 204 which intersect at 206 along the plane of the front-to-rear centerline, with the line of intersection 206 inclined front-to-rear, that is lower at the front and higher at the rear.

Nail block 190 is assembled in the cutout 156 with shoulder bolts (not shown) extending from the bottom 162 through bores 160 and into bores 192. The threaded ends of the bolts are threaded into the threaded deeper portions 196. Springs (not shown) surround the bolts and reside in the enlarged portions 194 biasing the nail block 190 normally upwardly.

Figure 19:
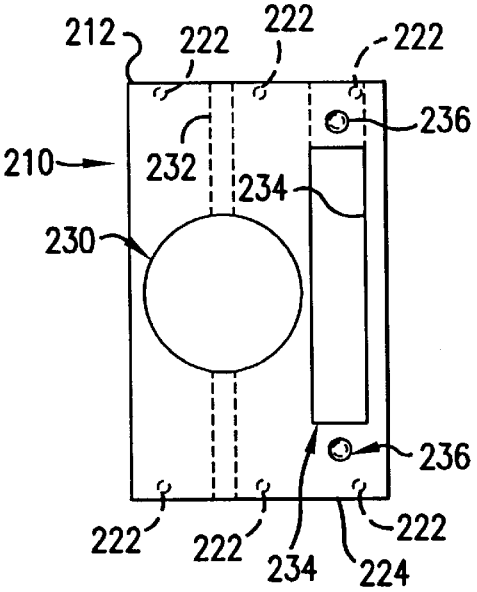
FIG. 19 is a top plan of the pad and squeegee head.
Figure 20:
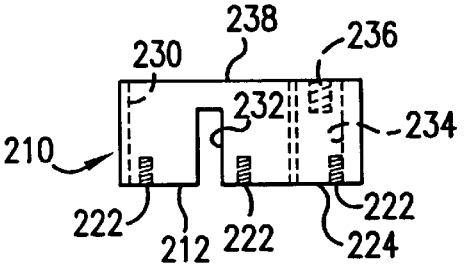
FIG. 20 is an end elevation of the pad and squeegee head.

A pad and squeegee head 210 is shown in FIGS. 19 and 20 and is adapted to slide in the guide slots 90 in the following manner. A pair of nylon (or other suitable plastic guide rails 214 are attached along the lower side edges 212 of head 210. Rails 214 are L-shaped in configuration with a horizontal leg 216 and a vertical leg 218. Leg 216 is provided with three space holes 220 which align with three spaced tapped holes 222 in the bottom surface 224 of head 210 along each bottom edge 212. Screws (not shown) fasten rails 214 to head 210 in this manner. The vertical leg 218 is received in the slots 90 and therefore, head 210 can move fore and aft. Leg 218, toward the front, defines an arcuate cutout 226 which matches when registered with the arcuate bottom of slot 62.

Head 210 includes a large circular throughbore 230, a lateral vertical slot 232 extending upwardly from the bottom surface 224 and intercepting the bore 230, a vertical throughbore 234 rectangular in cross-section, and a pair of threaded bores 236 laterally outside of and in proximity to bore 234. Bores 236 extend from the upper surface 238 of head 210.

Figure 21:
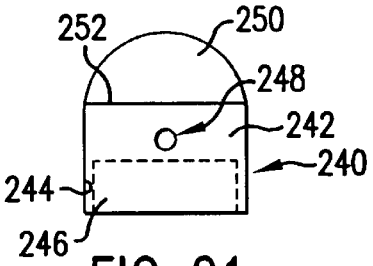
FIG. 21 is an elevational view of the pad holder.
Figure 22:
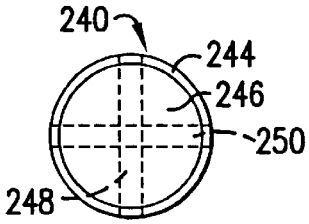
FIG. 22 is a bottom plan of the pad holder.
Figure 23:
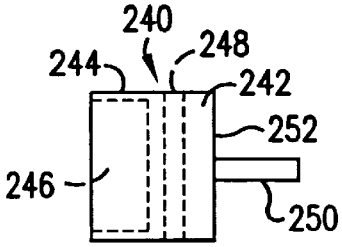
FIG. 23 is a side view of the pad holder.

A pad holder 240, circular in cross-section, shown in FIGS. 21–23 fits in bore 230. Holder 240 consists of a cylindrical body 242 having a depending annular skirt 244 defining a space 246 into which a silicone pad 246 is press fitted, see FIG. 3. A throughbore 248 passes diametrically through body 242 and a vertical gripping tab 250 extends upwardly from the top 252 of body 242.

A squeegee blade holder assembly is shown in FIGS. 28–32. The squeegee or doctor blade 260 is shown in 32 and is a rectangular piece of steel from about 0.005 inches to about 0.010 inches thick (preferably about 0.008 inches). Blade 260 is held in a blade holder 264 consisting of a block 266 having a cutout 268, a block 270 having a relieved area 271 to accommodate blade 260 that fits into cutout 268 and countersunk screws or bolts 269 that connected block 270 to block 266 via holes 272 in block 270 and threaded holes 274 in block 266. A pair of threaded holes 261 are located on the top side 263 of block 266 of blade holder 264. The surfaces 273 on opposite ends of blade 260 on the bottom side 275 of blade holder 264 serve as bearing surfaces. The blade holder 264 is received in a cavity 278 defined in the bottom 282 of blade assembly holder 280. A lifting tab 284 projects upwardly from the top surface 286 of holder 280. A pair of bores 288 extend from the top surface 286 down through the holder 280 opening into cavity 278. The top portion 290 of each of the bores 288 is enlarged to receive a bolt head of a shoulder bolt (not shown) that is fastened at it lower end to the 264 blade holder via threaded hole 266, and deep enough to allow vertical movement of the bolt head without extending significantly above top surface 286. The mid-portion 292 of each bore 288 is of reduced section to closely surround the bolt shank. The bottom portion 294 of each bore 288 is enlarged to enable a compression spring (not shown to surround the bolt shank and be sufficiently loaded to normally bias the blade holder 264 downwardly with a preselected force.

Figure 24:
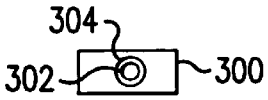
FIG. 24 is a plan view of a clip for the squeegee holder assembly.
Figure 25:
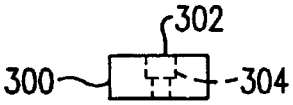
FIG. 25 is a side view of the clip shown in FIG. 24.
Figure 26:
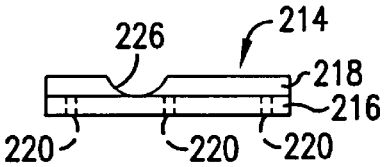
FIG. 26 is a side view of the side guide rails for the pad and squeegee head.
Figure 27:
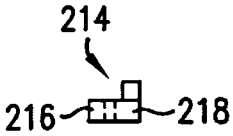
FIG. 27 is an end view of the rail shown in FIG. 26.
Figure 28:
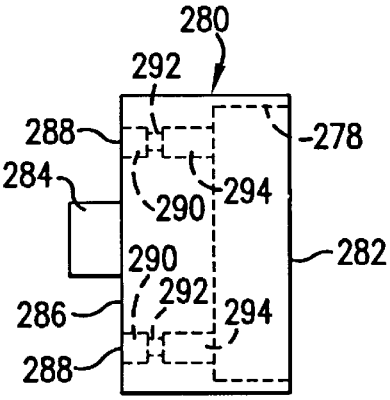
FIG. 28 is a side view of the head for the squeegee blade holder.
Figure 29:
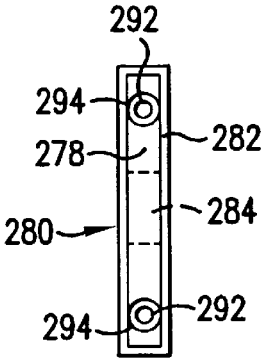
FIG. 29 is a bottom plan of the head shown in FIG. 28.
Figure 32:
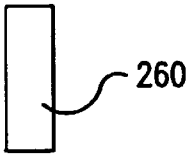
FIG. 32 is a side view of the blade.
Figure 30:
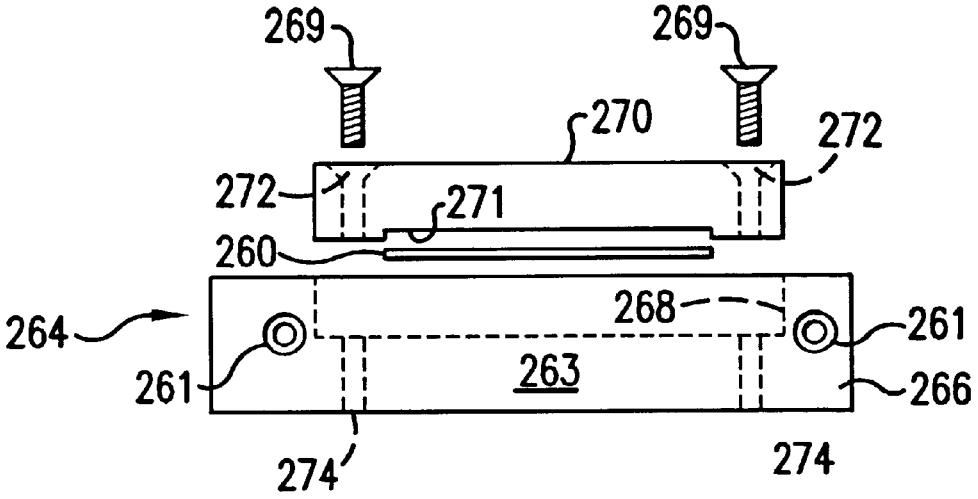
FIG. 30 is top exploded view of the blade holder.
Figure 31:
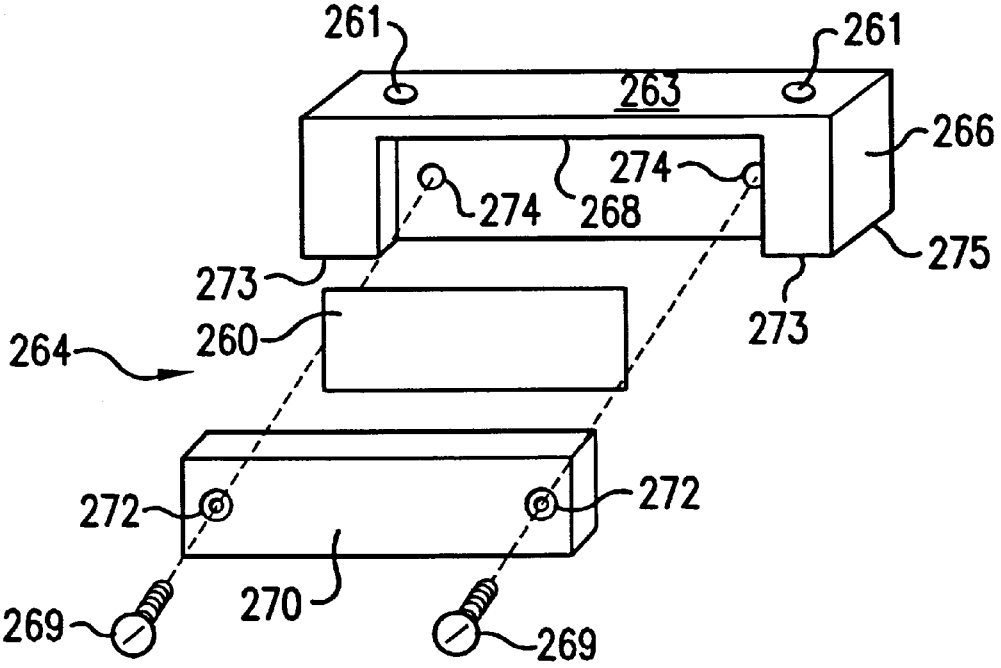
FIG. 31 is a perspective exploded view of the blade holder.

The holder 280, when assembled as described above, is received in the rectangular cavity 234 of head 210. A pair of clips 300, shown in FIGS. 24 and 25 are pivotally mounted on head 210, one on each side of cavity 234. Each clip 300 is a small bar defining a through bore 302 having an upper enlarged portion 304 to accommodate a bolt head. The clips 300 are mounted to head 210 by shoulder bolts (not shown) which thread into threaded holes 236. By using shoulder bolts, the clips 300 are freely rotatable. Initially the clips 300 are pivoted away from cavity 234, the assembly of head 280, blade holder 264 and blade 260 is inserted into cavity 234 and then clips 300 are pivoted to overlie the edges of head 210 to hold it in the cavity 234. This action takes place in the machine while the doctor blade 260 or blade holder 264 is bearing against an undersurface.

Figure 12:
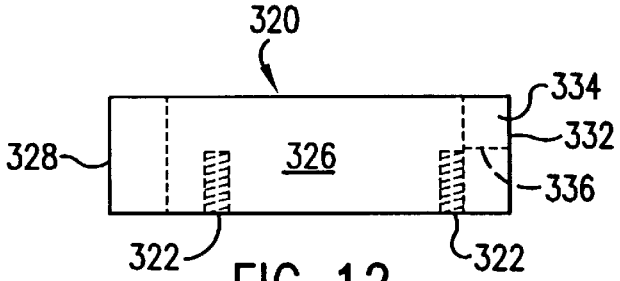
FIG. 12 is a top plan view of the squeegee slide.
Figure 13:
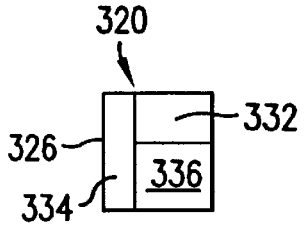
FIG. 13 is an end view of the squeegee slide.
Figure 14:
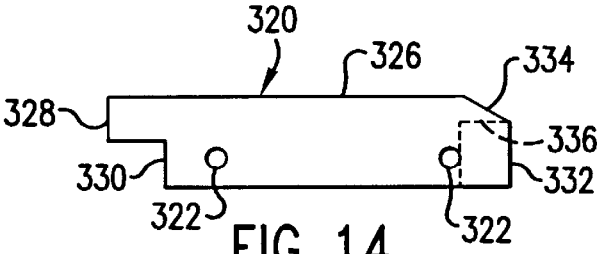
FIG. 14 is a side view of the squeegee slide.
Figure 15:
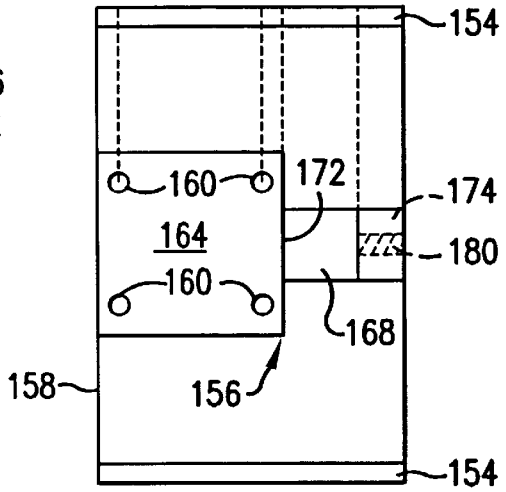
FIG. 15 is a top plan view of the nail block holder.
Figure 16:
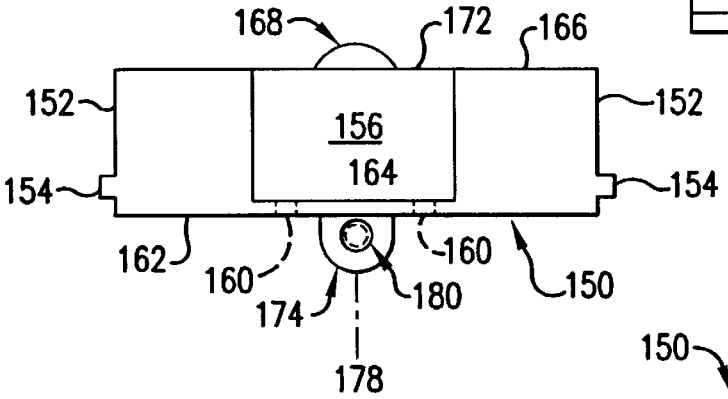
FIG. 16 is front elevation of the nail block holder.
Figure 33:
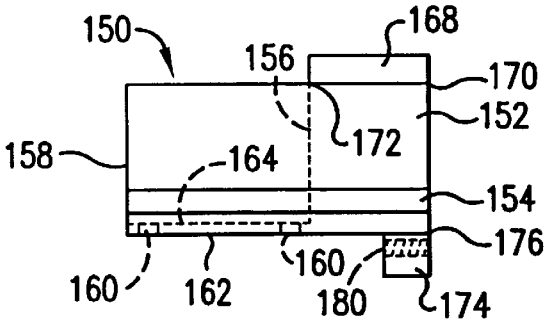
FIG. 33 is a side elevation of the nail block holder.

A pair of nylon slides is shown in FIGS. 12–14. Each consists of an elongated bar 320 provided with a pair of horizontally spaced, transversely extending threaded through bores 322 for attachment to a side rail 24, 26. One bar 320 is attached horizontally to the inside surface of each side rail 24, 26 by means of bolts 324, see FIG. 1. The bars 320 underlie the head 210 as it slides fore and aft and provide cooperating horizontal bearing surfaces 326 for bearing surfaces 270 of blade holder 264. The lower portion of the forward end 328 of bar 320 is cutout 330 to accommodate sliding movement of nail block holder 150. The upper corner of rear 332 of bar 320 is leveled at 334 to provide a ramp or incline. The lower inside corner of the rear end 332 is cutout 336 to accommodate wheel 126, so that the ramp 334 at least partially overlies in close proximity the upper surface of wheel 126, so that as head 280 is moved in the fore direction from its aft-most position, the blade holder 264 will ride up the ramp 334, retracting blade holder 264 and blade 260 into cavity 278 against the spring bias. Thereby, blade 260 is disengaged during further forward travel.

Figure 34:
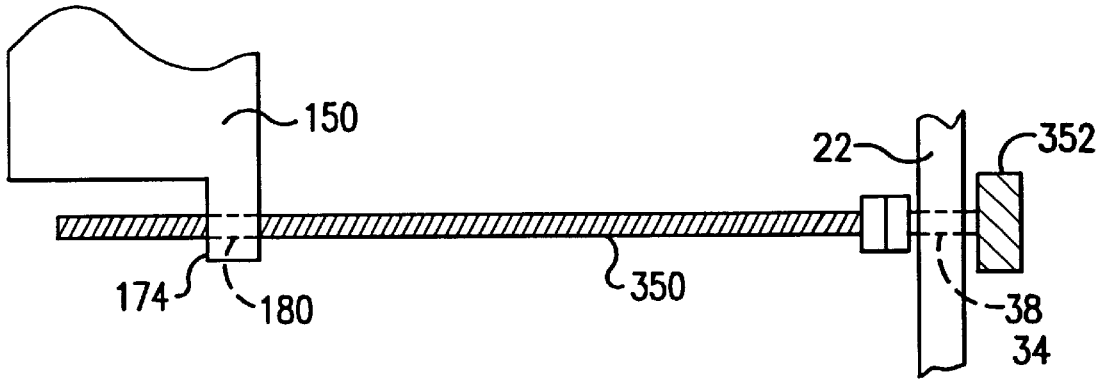
FIG. 34 is a view of the operating lead screw.

The operating lead screw is shown in FIG. 34 and consists of a threaded rod 350 having a turning knob 352 fixed at one end. In the preferred embodiment, the rod 350 is inserted from the rear, passing through bore 38 in hub 34 in the rear leg structure 22, and is threaded through bore 180 in projection 174 of nail block holder 150. The end of rod 350 does not extend to or through bore 38 in hub 34 in the front leg structure 20. A pair of nuts 351 on the inside of rear leg structure 22 one tightened to the other and knob 352 fixed on rod 350 just on the outside of leg structure 22 serve to maintain rod 350 in a fixed longitudinal position while allowing free rotation. The threaded portion of rod 350 threadedly engaged with threaded bore 180 enables rotation of rod 350 by knob 352 to cause nail block holder to slide fore or aft depending upon the sense or direction (CW or CCW).

Figure 35:
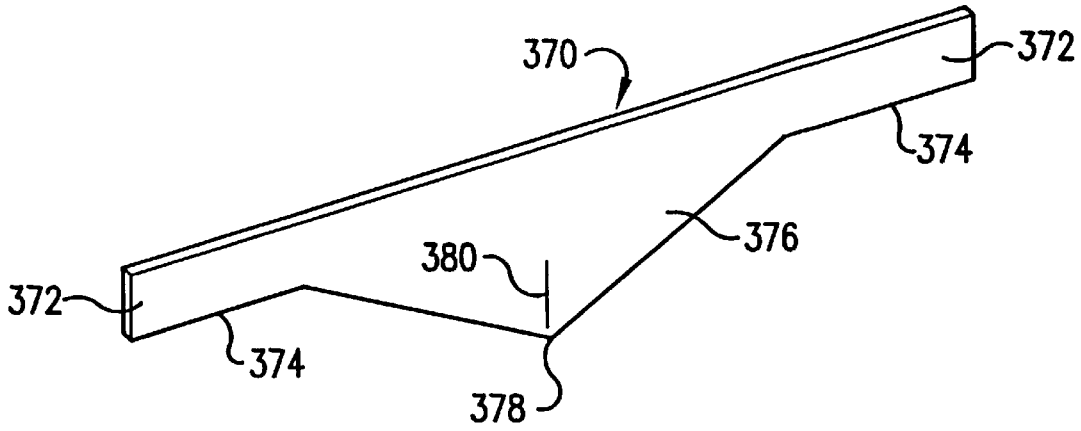
FIG. 35 is a perspective view of the index pointer.

The upper surfaces of the side rails 24, 26 directly above the centerline of slots 62 is matched at 360 with an arcuate bottom 362 to receive an indexing pointer 370 preferably made of plastic as shown in FIG. 35. Pointer 370 is a flat bar having side arms 372 with lower arcuate surfaces 374 for engagement with notches 360. This positions the pointer 370 upright in a vertical plane. The lower triangular portion 376 points downwardly and the apex 378 at the extreme bottom in the middle of pointer 370 is the index pointer to designate the exact point that an image carried by pad 246 will be deposited onto a nail. A vertical sight line 380 is scribed into or otherwise created in exact vertical alignment with apex 378.

Figure 36:
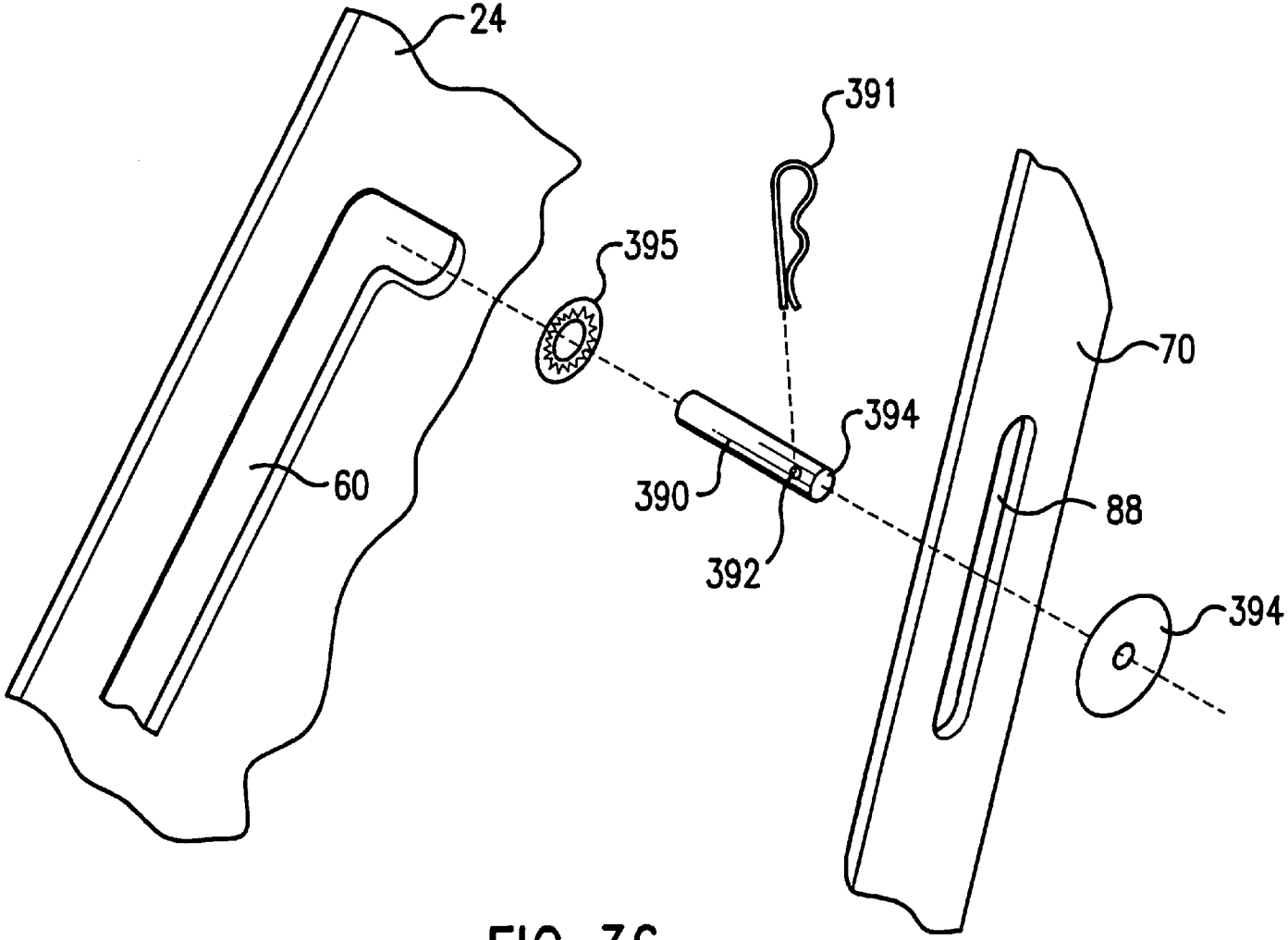
FIG. 36 is an exploded view of the operating pin, lever arm and side rail.

The operating pin 390 is shown in FIG. 36. This pin 390 extends transversely through the machine from arm 70 to arm 72. The central portion of pin 390 passes from slot 60 on one side, through the head 210 (slot 232), through the pad holder 240 (hole 248) and into slot 60 on the other side. The ends 394 of pin 390 project into and through the slots 88 of arms 70, 72, projecting slightly. A washer 394 is received on each end 394 outside its associated arm 70, 72. A through-bore 392 is formed in each end 394 and retainer spring clip 391 is received in hole 392 to hold washer 394 against its arm. A roller bearing 395 is mounted on pin 390 and rides in slot 60 on each side to facilitate movement of pin 390 by lever arms 68.

The operation is as follows. The lever arms 68 are brought to a neutral position substantially as shown in FIG. 1. A plate 14*a* is loaded into recess 128 of the wheel 126. A persons's finger is placed in the V-groove of nail block 190 with the end of the finger bearing against hemi-cylindrical projection 168 and the fingernail just overlying the forward end of projection 168. The index pointer 370 is placed in notches 360 and knob 352 is manipulated to align the area of the fingernail onto which the image is to created, under the index point 378. A small amount of coloring material is placed just forward of the forwardmost image 142 on plate 140. In one smooth continuous motion the lever arm 68 is pivoted rearwardly until pin 390 reaches the bottom of slot 64 and, then, pivoted forwardly until pin 390 reaches the bottom of slot 62 and finally, back to the neutral position. During this motion the coloring material will be doctored rearwardly, the pad will travel rearwardly and descend and pick up the coloring material from the engraved image 142, the pad will lift up and travel forwardly and descend to transfer the picked up coloring material to the fingernail, and then, lift up and return to the neutral position. At this point, the wheel 126 can be indexed a quarter of a turn to present a fresh engraving 142. The engraving 142 may be independent or parts of a single overall image with the separate engravings 142 constituting parts of different color. The various combinations and permutations of the engravings 142 will be readily apparent to one skilled in the art.

Instead of a plate containing four engravings, it may contain from two to about six engravings with the turntable modified to define detent recesses corresponding in number and geometry to match the number of engravings. Plate 140 and recess 128 can be any matching polygon configuration.

Figure 37:
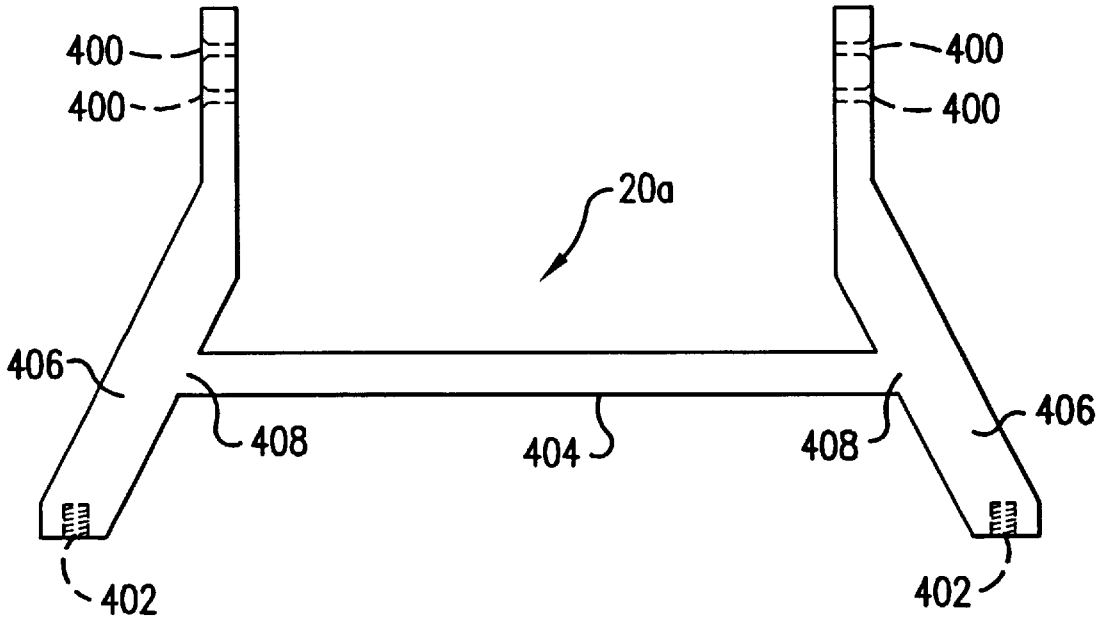
FIG. 37 is a side view of an alternate forward leg structure.

FIG. 37 shows a side view of a preferred construction for front leg structure 20, which is designated in the figure by the reference number 20*a*. Countersunk clearance holes 400 are provided for attachment of the side rails. Threaded holes 402 are provided for attachment of suction pads. The principal change is a lowering of crossbar 404 and no hub or hole. In this instance, crossbar 404 is moved down and interconnects the legs 406 at an intermediate point 408 of the splay or outward incline. The purpose of this construction is to allow greater clearance for the nail block and its holder.

The foregoing disclosure has been set forth merely to illustrate the invention and is not intended to be limiting. Since modifications of the disclosed embodiment incorporating the spirit and substance of the invention may occur to persons skilled in the art, the invention should be construed to include everything within the scope of the appended claims and equivalents thereof.

What is claimed is:

1. A method for applying an art image on a person's nail comprising the steps of:

establishing a reference point;

adjustably positioning a person's digit relative to the reference point at a first preselected location;

creating an image composed of an image defining coating material at a location remote from the first preselected location;

picking up the created image from said remote location by a movably mounted transfer element;

transferring the picked up image to the person's nail at said first preselected location in one smooth continuous motion that results in the picked up image being deposited onto the person's nail at a position on the nail correlated with the reference point.

2. A method according to claim 1, wherein the transfer element containing the picked up image is transferred by a pivoting driver.

3. A method according to claim 2 wherein creating the image includes the steps of depositing coating material onto a plate in the vicinity of where the image is created and doctoring excess coating material away from where the image is created.

4. A method according to claim 1 including the step of guiding the transfer of the picked up image.

5. A method according to claim 1, wherein the depositing of the picked up image is effected by the extreme motion of the driver.

6. A method according to claim 1 wherein the steps are repeated a multiple of times with presentation of a different image each time to obtain a multi-part image on the person's nail.

7. A method according to claim 6, wherein a different color image defining coating material is used each time.

8. A method according to claim 1, wherein the reference point is defined by a pointer.

9. A method according to claim 8, wherein the positioning step includes the step of adjusting the physical position of the person's digit.

10. A method according to claim 1 further including a step of positively changing direction of the transfer of the picked up created image in proper orientation to the person's nail during transfer.

11. Hand-operated self-contained machine for applying an image on a nail of a person's digit comprising:

a frame;

an element for establishing a reference point relative to the frame;

an image creating plate mounted on said frame for creating thereon an image composed of an image defining coating material;

an adjustable digit positioning member for receiving and adjustably positioning a person's digit relative to the location of the created image to achieve an orientation relative to the reference point, a transfer member movably mounted on said frame for transferring a created image from the image creating plate to the person's nail; and a drive member for moving said transfer member in one smooth continuous motion that results in a created image being transferred and deposited on the person's nail at a position correlated with the reference point.

12. Machine according to claim 11, wherein said plate includes a plurality of images formed thereon.

13. Machine according to claim 11 wherein said transfer member includes a squeegee for removing excess coating material from an image and a pick up pad for picking up a created image.

14. Machine according to claim 13 wherein said squeegee and said pick up pad are mounted in common with the pad mounted additionally for vertical movement.

15. Machine according to claim 13 wherein the squeegee is spring biased.

16. Machine according to claim 13 wherein guide rails are provided to lift the squeegee during movement of the transfer member.

17. Machine according to claim 11 where in the digit positioning member is adjustably positioned by a lead screw.

18. Machine according to claim 11 wherein the digit positioning member includes a spring biasing upwardly the block having a V-shaped groove.

19. Machine according to claim 11, further including guide elements to guide said transfer member during movement.

20. Machine according to claim 11 wherein said drive member pivots to drive said transfer member.

* * * * *